US005881651A

United States Patent [19]

Trickett

[11] Patent Number: 5,881,651

[45] **Date of Patent: *Mar. 16, 1999**

[54] SLIP SHEET WITH GRIPPING EDGE

[76] Inventor: Howard J. Trickett, 2699 Pontius Rd., Hartville, Ohio 44632

[ * ] Notice: The term of this patent shall not extend beyond the expiration date of Pat. No. 5,613,447.

[21] Appl. No.: 823,698

[22] Filed: Mar. 25, 1997

[51] Int. Cl.[6] ..... B65D 15/00

[52] U.S. Cl. ..... 108/51.11; 108/57.16; 108/56.1; 206/596

[58] Field of Search ..... 108/57.16, 51.11, 108/27, 51.3, 501, 56.1, 57.25, 57.28; 206/596, 598, 599, 386; 248/346.01, 346.02

[56] References Cited

U.S. PATENT DOCUMENTS

| | | | |
|---|---|---|---|
| 2,913,206 | 11/1959 | Paris | 206/386 |
| 3,282,621 | 11/1966 | Peterson | 206/386 X |
| 3,850,116 | 11/1974 | Mackes | 414/787 |
| 4,042,127 | 8/1977 | Brossia | 108/51.3 X |
| 4,570,546 | 2/1986 | Batelka | 248/346.01 |
| 4,649,007 | 3/1987 | Bonis et al. | 108/57.25 X |
| 5,062,370 | 11/1991 | Etlinger | 108/51.3 X |
| 5,613,447 | 3/1997 | Trckett | 108/56.1 X |

FOREIGN PATENT DOCUMENTS

| | | | |
|---|---|---|---|
| 5051037 | 3/1993 | Japan | 108/51.1 |
| 800453 | 8/1958 | United Kingdom | 108/51.3 |
| 9100831 | 1/1991 | WIPO | 108/51.1 |

*Primary Examiner*—Janet M. Wilkens
*Attorney, Agent, or Firm*—Emerson & Associates; Roger D. Emerson; John M. Skeriotis

[57] ABSTRACT

A slip sheet for receiving goods is provided with a compressible tab portion extending outwardly from at least one side edge. The compressible tab portion has a convex airfoil-type cross-sectional area to facilitate grasping of the airfoil shaped tab portion, the compressible tab portion being canted upwardly from a plane defined by the flat portion of the slip sheet to further facilitate grasping.

3 Claims, 6 Drawing Sheets

SLIP SHEET WITH GRIPPING EDGE

BACKGROUND ART

The movement of a variety of goods in commerce is dictated by the economics of packaging. In many cases, goods previously transported on wooden pallets have been unitized into wrapped packets attached to a slip sheet, particularly a slip sheet which may be manufactured from recycled polymeric materials near the point of use and either reused or recycled at the terminus point, avoiding the costs of shipping the pallets empty for reuse. Also, there are environmental issues involved with the use of wood, particularly deforestation issues in regions where some of the previously palletized products, such as rubber, are produced. Additionally, wood in pallets and crates are subject to infestation by wood borers and insects, which can introduce unwanted and harmful insects into the ecosystem. Polymeric materials are generally not edible by insects, so the infestation potential is greatly reduced.

In a co-pending patent application, Ser. No. 08/399,490 issued U.S. Pat. No. 5,613,447 on 25 Mar., 1997, the present inventor teaches a slip sheet for transporting goods which has a compressible tab portion of convex airfoil-type cross-sectional area along at least one edge of the slip sheet, with an upstanding wall provided along each edge of the slip sheet. Improvements in that invention now make It possible to provide a slip sheet with the same type of compressible tab portion with the convex airfoil-type cross-section, but in which the construction of the tab provides that the tab be generally upturned for easier grasping by the lift vehicle typically used.

SUMMARY OF THE INVENTION

It is, therefore, an object of the present invention to provide a slip sheet useful in the transport of goods having a tab portion with a convex airfoil-type cross-section formed along at least one edge of the slip sheet with the tab portion being obliquely canted upwardly relative to the flat surface for receiving goods.

BRIEF DESCRIPTION OF THE DRAWINGS

Better understanding of the present invention will be achieved by reference to the accompanying drawings, which are made a part hereof, in which identical parts are designated by identical part numbers and in which.

DETAILED DESCRIPTION OF THE DRAWINGS

Figure 1:
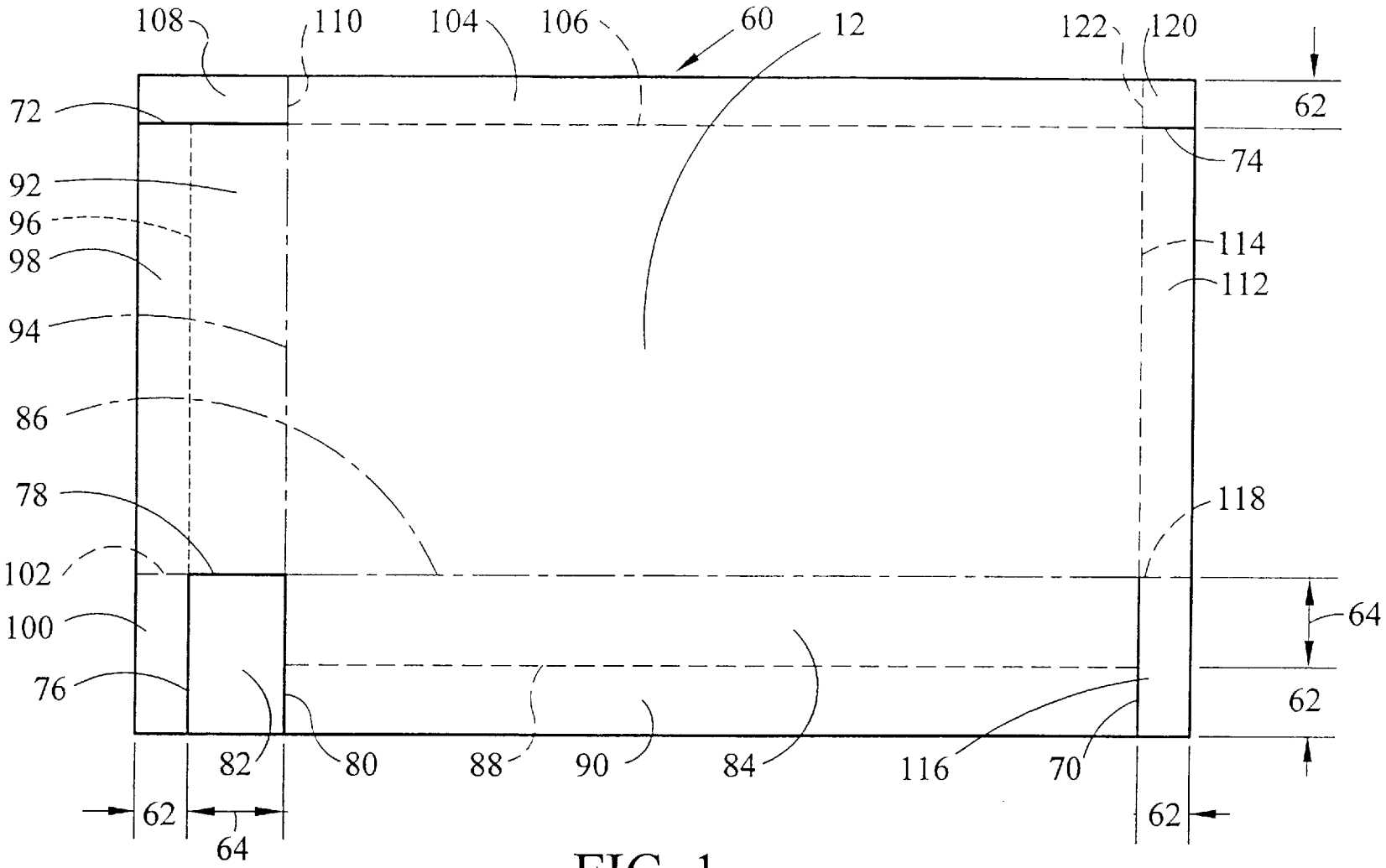
FIG. 1 shows a first embodiment of a slip sheet for transporting goods in unassembled top plan view.

A first embodiment of the slip sheet of the present invention is shown in an unassembled top plan view in FIG. 1. The slip sheet will be a non-wooden material and preferably a polymeric material, even more preferably a recyclable material. Still more preferably, the slip sheet will be formed from a previously-processed polymer, that is, a polymer that has been previously subjected a thermal molding process and the degradation inherent therein. The preferred slip sheet will be manufactured from a material that lacks nutritive or nesting interest, particularly to insects, thereby preventing or at least minimizing insect infestation. In some circumstances, paper and metallic materials may be acceptable and, in fact, preferred. As shown in FIG. 1, the slip sheet has a working area or "footprint" size being a rectangular area 12, which is sized for the purpose of receiving the intended goods to be transported. The slip sheet has a thickness that is significantly less than either the width or length, so that the slip sheet is in essence a two-dimensional body. The preferred thickness for the slip sheet is in the range of about 0.015 to about 0.080 inches and preferably in the range of 0.040 to 0.060 inches. To be effective, the slip sheet must have sufficient rigidity to support the load, so a minimum thickness is required, but the slip sheet should not be much thicker than required, since additional thickness adds only weight and cost to the overall transport unit.

Polymeric materials that are useful for the slip sheet include the polyolefins such as polyethylene, especially high density polyethylene ("HDPE") and polypropylene, as well as polyesters such as poly(ethylene terephthalate) ("PETE"). In addition to the use of "virgin" polymers, that is, polymer materials that have previously not been thermally processed or molded, the slip sheet may well be prepared from previously-processed polymer materials. To the extent that polyolefins and polyesters are available, desirable starting materials for the slip sheet may include recycled bottles and other containers. For example, two liter soft drink bottles are produced from poly(ethylene terephthalate) and a large variety of other packaging materials comprise polyethylene, particularly high-density polyethylene.

Once goods are packed atop the slip sheet for transport, the slip sheet must be transported to the point of use. The transport of palletized loads is well known, but the standard forklift-type vehicle used for transport of pallets is not appropriate for use with the slip sheet, since the standard fork of such a vehicle would be likely to penetrate the stretch-wrapped bales and it might have difficulty in getting under the slip sheet for a proper lift. However, there is a type of adaptation for a lift-type truck for use with slip sheets and this type of truck would be appropriate for use in this application. An example of such a truck is the push/pull type truck produced by Cascade Corporation of Portland, Oreg., among others. In such a truck, the fork is replaced with a flat horizontal platen and a vertical faceplate that can be moved along the length of the platen. The faceplate has a gripper portion at the lower end thereof for gripping a tab of the slip sheet. Once the tab is grasped by the gripper portion, the transport unit can be pulled back onto the platen for carrying. The faceplate can then be moved forward to push the transport unit off of the platen at the desired destination. After the gripper portion's grasp of the tab is released, the platen can be withdrawn from under the slip sheet.

Figure 2:
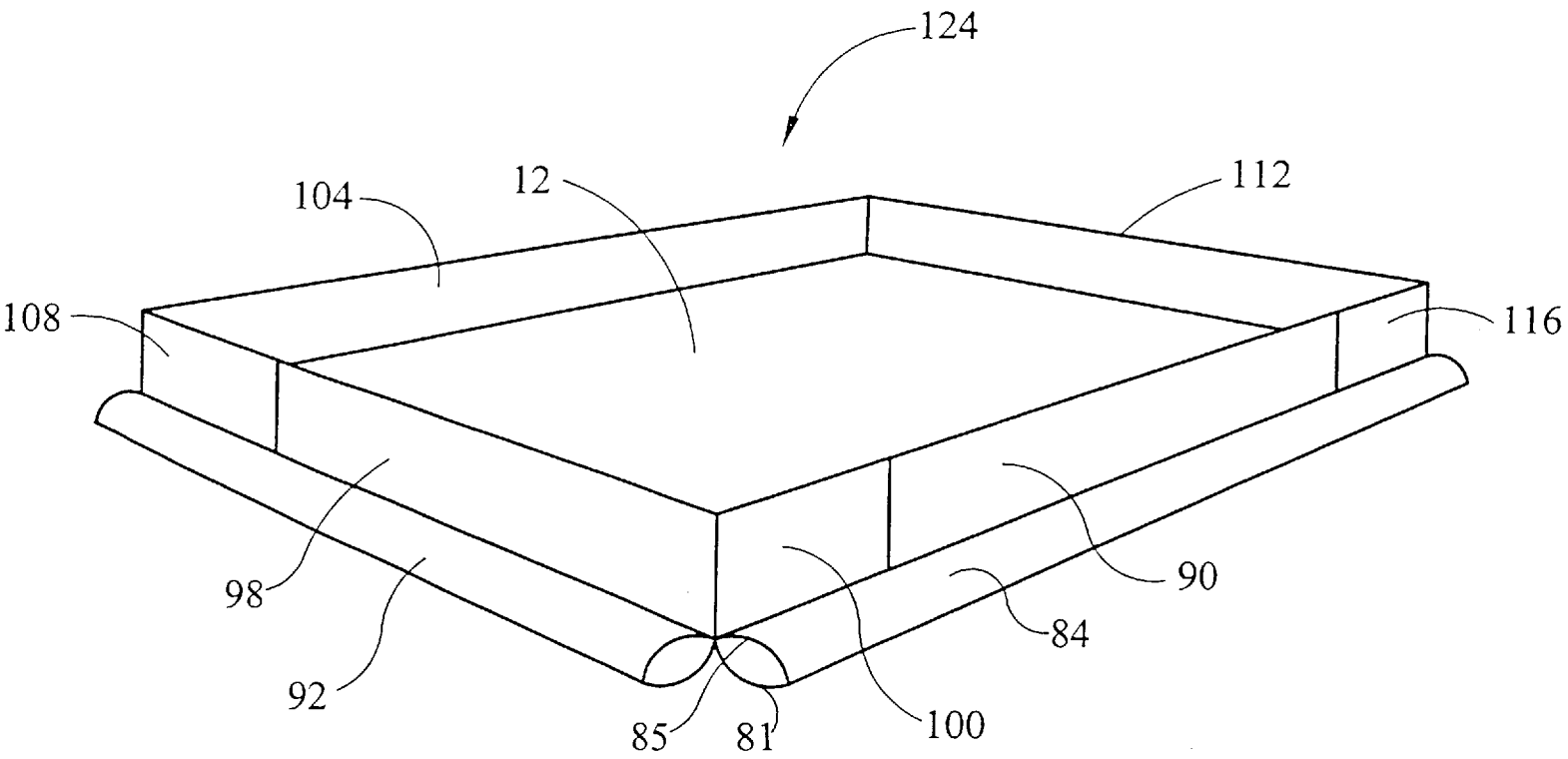
FIG. 2 shows the first embodiment of a slip sheet in assembled perspective view.

The embodiment of FIGS. 1 and 2 shows a slip sheet having improved grasping tabs on two side edges and four upstanding walls. A rectangular sheet 60 of the desired plastic material is obtained. To determine the size of the sheet needed, one must first determine the size of the footprint 12 desired, as well as the height of the upstanding walls and the depth of the tabs to be formed. In a typical slip sheet, the desired wall height will be about 4 inches and the desired depth of the tabs will be about four inches. A typical footprint area for the formed slip sheet will be about 54 inches by 41 inches, although a variety of footprint sizes are also known, including 45 inches by 45 inches. To obtain the final footprint, the starting sheet should have a width equal to the footprint width plus two times the height of the desired wall plus two times the desired tab depth. Likewise, the starting sheet 60 should have a height equal to the footprint width plus two times the height of the desired wall plus two times the desired tab depth. Based on a width of 54 inches, a height of 41 inches, a wall height of 4 inches and a tab depth of 4 inches, this formula would require a starting sheet that is 54+8+8 or 70 inches wide by 41+8+8 or 57 inches high. Such a sheet 60 is shown in top plan view in FIG. 1.

While the following describes a method for assembling the slip sheet having improved grasping tabs on two sides and four upstanding walls, it will be understood that other assembly methods are possible and that this method is taught only for illustrative purposes. In FIG. 1, cut lines are shown by solid lines, fold lines are shown by dashed lines and dot-dash lines show registration lines. A first cut 70 is made into the sheet. Cut 70 is made one wall height 62 in from the corner. The depth of the cut 70 into the sheet is one wall height 62 plus twice the tab depth, which is shown as 64. A second cut 72 is made in a similar fashion. Cut 74 is made one wall height 62 from a third corner, and this cut has a depth equal to one wall height 62. Cuts 76, 78 and 80 result in removal of a rectangular piece of material 82. Now piece 84, bounded by cuts 70, 80 and registration line 86, is folded over so that fold line 88 lies atop registration line 86. The material along fold line 88 is attached to registration line 86 by thermal welding, stapling or similar attachment means. Then, the portion 90 bounded by cuts 70 and 80 and fold line 88 is folded upwardly to form an upstanding wall. The folded portion between cuts 70 and 80, registration line 86 and fold line 88 forms a compressible tab having a generally airfoil cross-section.

Similarly piece 92, bounded by cuts 72, 78 and registration line 94, is folded over so that fold line 96 lies atop registration line 94. The material along fold line 96 is attached to registration line 94 by thermal welding, polymeric rivets, stapling or similar attachment means. Then, the portion 98 bounded by cuts 72 and 78 and fold line 96 is folded upwardly to form an upstanding wall. The folded portion between cuts 72 and 78, registration line 94 and fold line 96 forms a compressible tab having a generally airfoil cross-section.

The tabs having been formed and two walls 90 and 98 having been formed, portion 100 is folded along line 102, registered atop wall 90 and fastened into place by polymeric rivets, stapling, thermal welding or the like. Then portion 104 is folded upwardly along fold line 106, forming a third upstanding wall. Portion 108 is folded along fold line 110, registered atop wall 98 and fastened into place by polymeric rivets, stapling, thermal welding or the like. Portion 112 is folded upwardly along fold line 114, forming a third upstanding wall. Portion 116 is folded along fold line 118, registered atop wall 90 and fastened into place by polymeric rivets, stapling, thermal welding or the like. Finally, portion 120 is folded along fold line 122, registered atop wall 112 and fastened thereto.

Referring now to FIG. 2, the assembled slip sheet, 124 of the present invention is shown, with upstanding walls 90, 98, 104 and 112, as well as grasping tabs 84 and 92. Folded portions 100, 108 and 116 that are registered and affixed to walls 90, 98 and 90, respectively, are also shown. The advantage of tabs 84, 92 from those known in the prior art is the airfoil-type cross-section, which permits the grasping fingers on a push/pull type lift truck to obtain a better grip thereupon. Upstanding walls 90, 98, 104, and 112 provide several advantageous functions not known in the prior art. First, the four upstanding walls form a closed perimeter that assists in holding the materials placed upon the slip sheet 124. Because of this, it is not necessary to selectively coat some surfaces of the slip sheet with a slip-resistant material to prevent slippage of the materials on the slip sheet. Second, the upstanding walls are tall enough that they provide protection against damage to the goods on the slip sheet by accidental puncture from the gripping fingers of the push/pull type lift truck. This type of puncture damage is particularly a problem when the goods being stacked on the slip sheet comprise bags of fine solids, such as bags of flour or the like. Third, the upstanding walls provide a surface against which stretch or shrink wrap may be adhered, to help to hold the stretch or shrink wrap in place, when a completed transport bundle has been formed.

The particular advantages of the slip sheet 124 may be even more fully obtained when a variation on the assembly method is performed. As taught above, the tab 84 is formed by folding material over and registering fold line 88 lies atop registration line 86 and the material along fold line 88 is attached to registration line 86 by thermal welding, stapling or similar attachment means. If this is done so that the fold occurs halfway between lines 86 and 88, it will be seen that the tab 84 formed will have a top portion 85 and a bottom portion 87 such that each of the portions 85 and 87 are approximately the same size. If the fold is made such that top portion 85 is formed with a smaller width than bottom portion 87, but line 88 is still registered atop line 86, the smaller top portion 85 will cause the tab 84 formed to be canted or angled upwardly from the horizontal. As an example, it is suggested above that tab 84 should be about 4 inches deep. If top and bottom portions 85, 87 are equally sized, each will be about 4 inches deep. If top portion 85 is about 3.75 inches deep and bottom portion 87 is about 4.25 inches deep, this approximately 12% difference is sufficient to produce a significant upward angle to the tab 84. If the top portion 85 is about 3.5 inches deep and the bottom portion 87 is about 4.5 inches deep, this approximately 25% difference produces a very clearly defined upward angle to tab 84. One way to express this relationship is in the ratio of the shift of the fold point from that which provides equal depths to the overall depth of the piece comprising tab 84. For example, an 8 inch piece of material folded evenly provides a 4 inch deep top portion 85 and a 4 inch deep bottom portion 87. This would be a shift of 0. If the fold line is moved outwardly by 0.25 inches, top portion 85 is 3.75 inches and bottom portion 87 is 4.25 inches and the ratio is 0.25:4, or 0.0625. When the fold line moves out by another 0.25 inches, top portion 85 is 3.5 inches, bottom portion 87 is 4.5 inches and the ratio is 0.125. A shift of 0.125 inches, resulting in a top portion of 3.875 inches and a bottom portion of 4.125 inches has been noted as being effective to sufficiently turn the edge upwardly. The ratio of lengths of the bottom portion to the top portion is preferably in the range of from about 1.06:1.00 to about 1.40:1.00.

Figure 3:
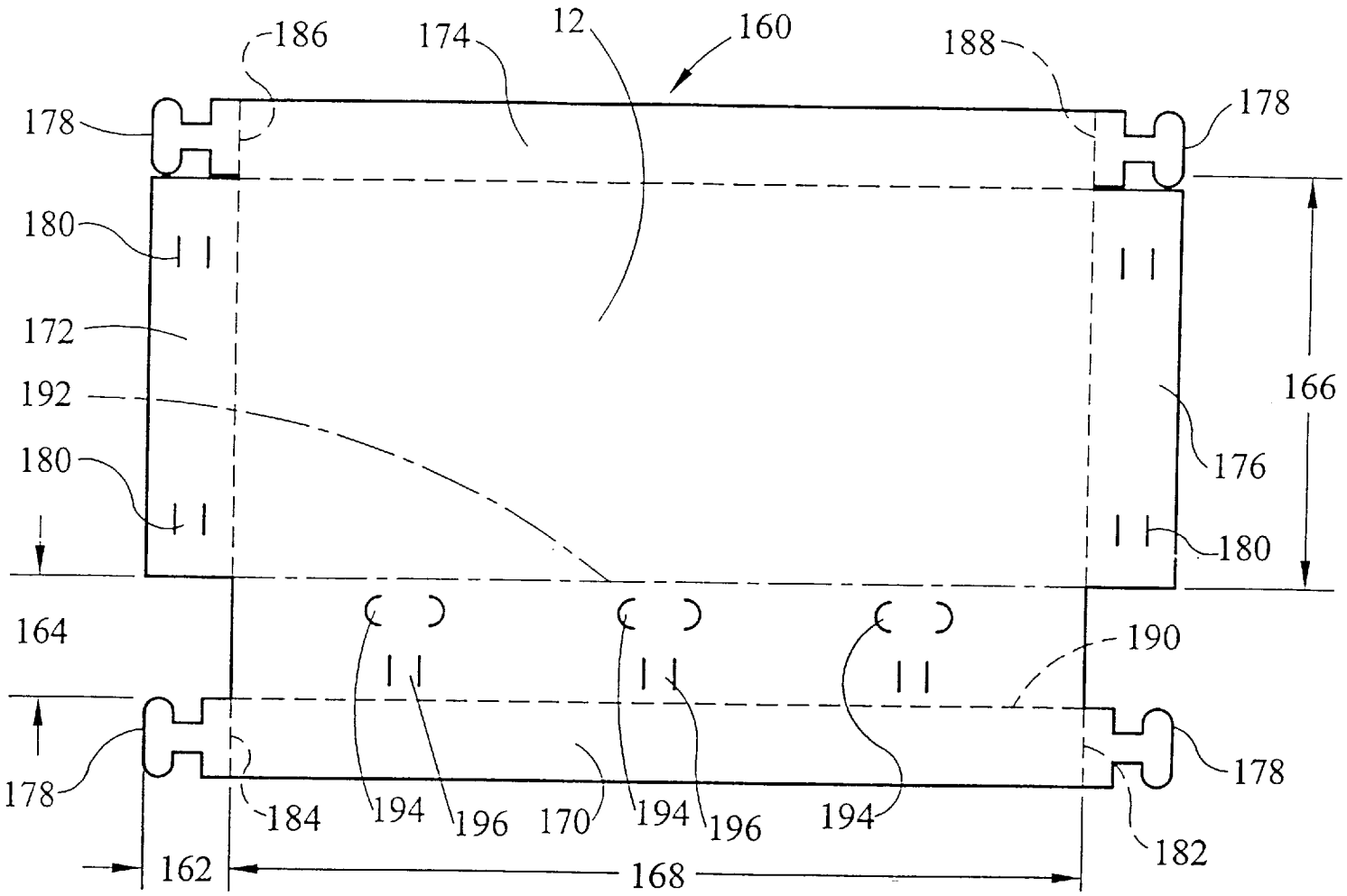
FIG. 3 shows a second embodiment of a slip sheet for transporting goods in unassembled top plan view.
Figure 4:
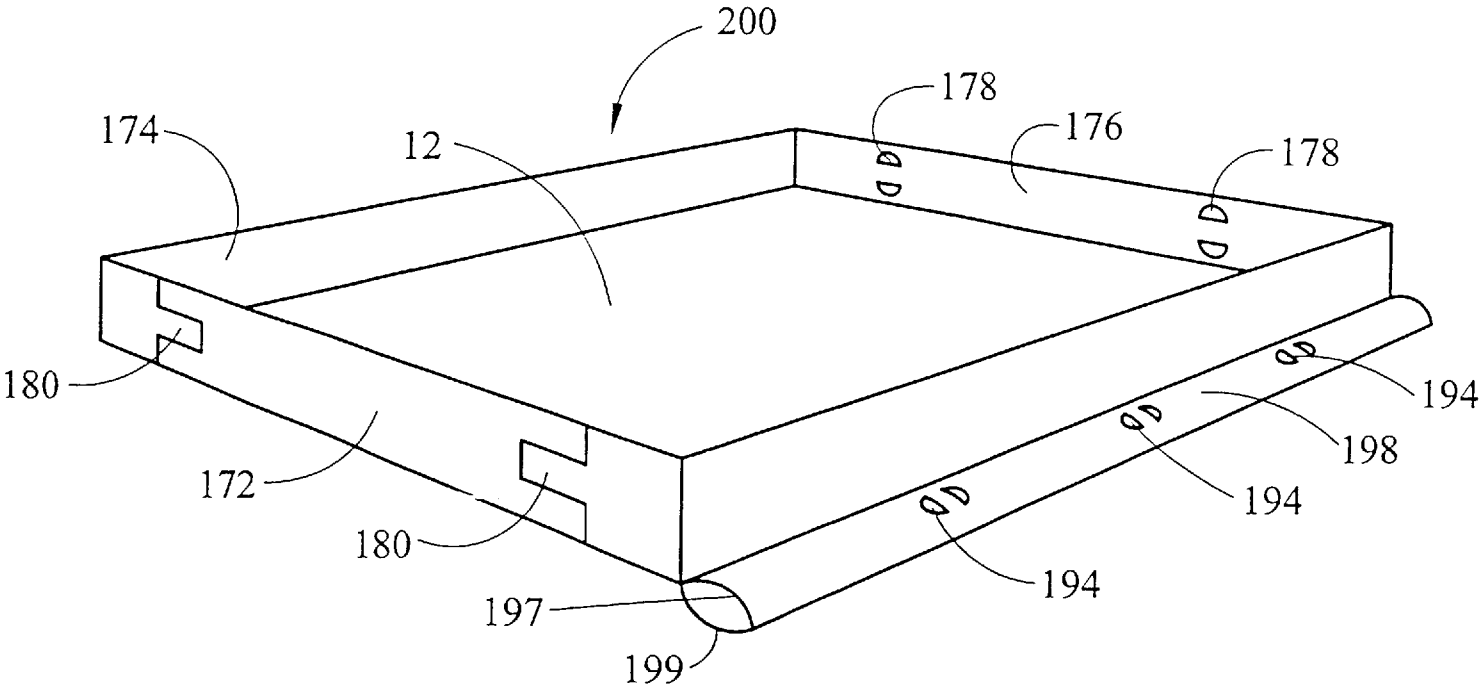
FIG. 4 shows the second embodiment of the slip sheet in assembled perspective view.

A further variation on the preferred embodiment is presented in FIGS. 3 and 4. In this variation, the embodiment has four upstanding walls, but only one grasping tab. Starting with a rectangular sheet 60 of the desired plastic material as described above, die cutting as described further below yields a blank 160 as shown in top plan view in FIG. 3. In FIG. 3, cut lines are shown by solid lines, fold lines are shown by dashed lines and dot-dash lines show registration lines. The intended slip sheet will have a wall height 162, a tab depth approximately one half of dimension 164, and a footprint 12 defined by length 166 and width 168. Side portions 170, 172, 174 and 176 will form the upstanding walls. Of these side portions, two of them, 170 and 174, have tabbed ends 178, for mating with corresponding slits 180 on side portions 172 and 176, when folds are made along the fold lines 182, 184, 186 and 188. Three of the upstanding walls 172, 174 and 176 are formed by these tabs and mating slits alone. To form the fourth upstanding wall 170, fold line 190 is registered atop registration line 192. To hold the piece in this position, a plurality of C-shaped tabs 194 cut into the piece are mated with a corresponding plurality of slots 196. This piece becomes the compressible tab 198 having a generally airfoil cross-section.

It will be recognized that the use of C-shaped tabs 194 and slots 196 can be used to form compressible tab 198 in which a top portion 197 is not as deep as a bottom portion 199. By moving the tabs 194 and slots 196 relative to registration line 192, the relative sizes of the top and bottom portions 197, 199 which are formed can be altered in exactly the same way as moving the fold line as described in association with FIGS. 1 and 2.

Referring now to FIG. 4, the preferred slip sheet 200 of the present invention is shown in perspective view, with upstanding walls 170, 172, 174 and 176, as well as grasping tab 198.

The preferred slip sheet 124 or 200 of the present invention may be comprised of the materials disclosed above, with HDPE being especially preferred. Of particular interest is HDPE in the range of from 40 to 60 mils thick.

Figure 5:
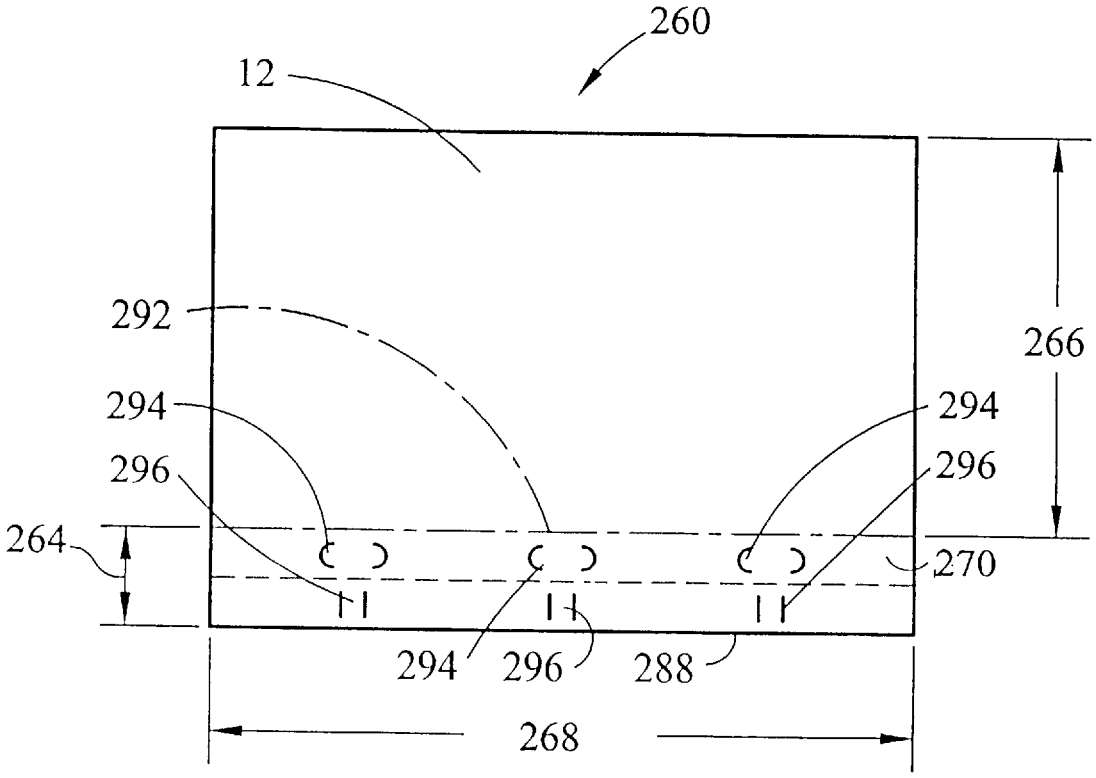
FIG. 5 shows a third embodiment of the slip sheet in unassembled top plan view.
Figure 6:
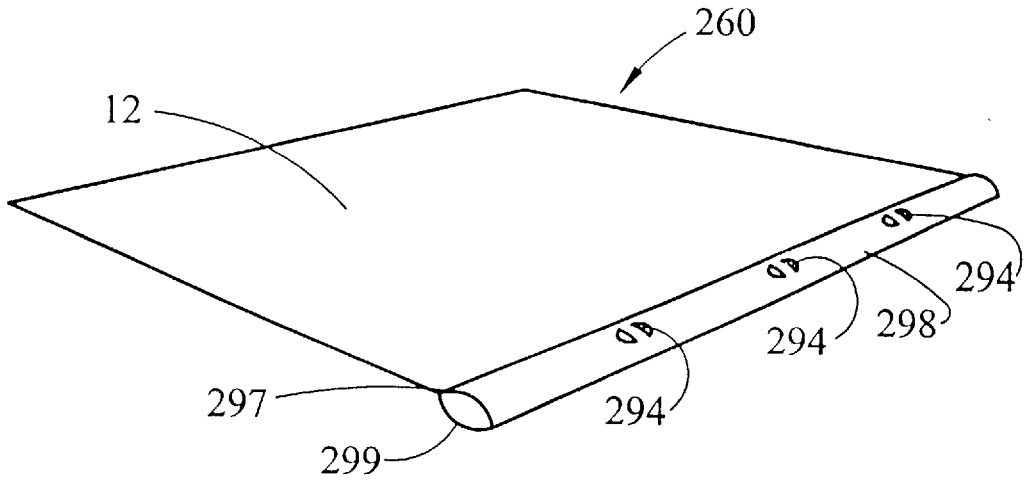
FIG. 6 shows the third embodiment of the slip sheet in assembled perspective view.

A yet further variation is presented in FIGS. 5 and 6. The compressible tab which cants upwardly may be provided in a slip sheet which has no upstanding walls. A blank 260 as shown in top plan view in FIG. 5 is provided. In FIG. 5, cut lines are shown by solid lines, fold lines are shown by dashed lines and dot-dash lines show registration lines. The intended slip sheet will have a tab depth approximately one half of dimension 264 and a footprint 12 defined by length 266 and width 268. One side portion 270 is used to form the compressible tab, by registering edge 288 atop registration line 292. To hold the piece in this position, a plurality of C-shaped tabs 294 cut into the piece are mated with a corresponding plurality of slots 296. This piece becomes the compressible tab 298 having a generally airfoil cross-section. To provide the upward angle to the compressible tab, the tabs 294 and slots 296 can be used to form compressible tab 298 in which a top portion 297 is not as deep as a bottom portion 299. By moving the tabs 294 and slots 296 relative to registration line 292 in the same manner as described above with regard to FIG. 3, the relative sizes of the top and bottom portions 297, 299 which are formed can be altered in exactly the same way as moving the fold line as described in association with FIGS. 1 and 2.

Figure 7:
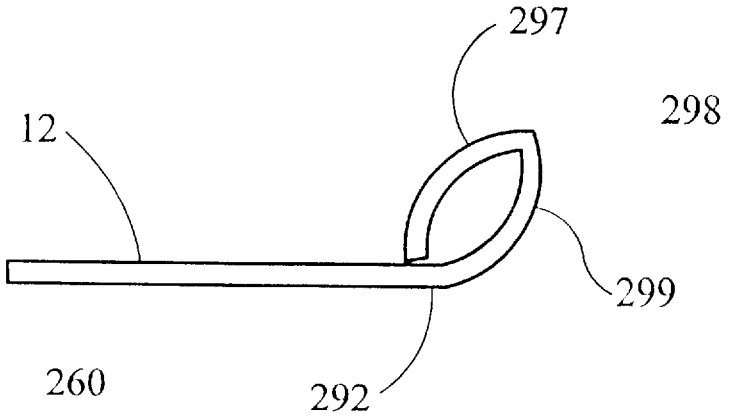
FIG. 7 shows an enlarged side view of the compressible tab portion of the slip sheet of the present invention.

FIG. 7 shows an enlarged side view of the compressible tab portion 298 of the slip sheet as shown in FIGS. 5 and 6, with top portion 297 and bottom portion 299 clearly shown.

While the patent law requirements of presenting the best known embodiment and an enabling disclosure have been achieved by the foregoing discussion, the scope of the invention is not intended to be limited thereto, but should be measured from the appended claims.

What is claimed is:

1. A slip sheet formed from a flat sheet of material comprising:

a flat portion for receiving goods, said flat portion having four side edges.

at least one said side edge having a compressible tab portion extending outwardly therefrom, said compressible tab portion having a convex airfoil-type cross-sectional area to facilitate grasping of the airfoil shaped tab portion;

wherein the compressible tab portion is canted upwardly from a plane defined by the flat portion of the slip sheet; and wherein the upward cant of the compressible tab portion is provided by the compressible tab portion having a bottom portion and a top portion such that the bottom portion is longer than the top portion.

2. The slip sheet according to claim 1 wherein the ratio of lengths of the bottom portion to the top portion is in the range of from about 1.06:1.00 to about 1.40:1.00.

3. A slip sheet formed from a flat sheet of material comprising:

a flat portion for receiving goods, said flat portion having four side edges, at least one said side edge having a compressible tab portion extending outwardly therefrom, said compressible tab portion having a convex airfoil-type cross-sectional area to facilitate grasping of the airfoil shaped tab portion by a push/pull type truck; wherein the compressible tab portion is canted upwardly from a plane defined by the flat portion of the slip sheet; and, wherein the side edge having the compressible tab portion is further provided with an upstanding side wall.

* * * * *